US008507417B2

(12) United States Patent
Buck et al.

(10) Patent No.: US 8,507,417 B2
(45) Date of Patent: Aug. 13, 2013

(54) ORGANOMOLYBDENUM-BORON ADDITIVES

(75) Inventors: William H. Buck, West Chester, PA (US); Douglas E. Deckman, Mullica Hill, NJ (US); L. Oscar Farng, Lawrenceville, NJ (US); Andrew G. Horodsky, Cherry Hill, NJ (US); Marcia G. Rogers, Mount Holly, NJ (US); Thomas J. Karol, Holualoa, HI (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 318 days.

(21) Appl. No.: 11/710,376

(22) Filed: Feb. 23, 2007

(65) Prior Publication Data

US 2007/0213236 A1 Sep. 13, 2007

Related U.S. Application Data

(60) Provisional application No. 60/779,800, filed on Mar. 7, 2006.

(51) Int. Cl.
*C10M 125/26* (2006.01)
*C10M 125/20* (2006.01)
*C10M 125/10* (2006.01)

(52) U.S. Cl.
USPC ..... 508/189; 508/185; 508/190; 508/199; 508/584

(58) Field of Classification Search
CPC . C10M 125/10; C10M 125/20; C10M 125/26
USPC ..... 508/108, 185, 189, 190, 194, 195, 508/199, 563, 584, 564; 556/57, 7
See application file for complete search history.

(56) References Cited

U.S. PATENT DOCUMENTS

| | | | | |
|---|---|---|---|---|
| 4,176,073 | A | 11/1979 | Ryer et al. | |
| 4,176,074 | A | 11/1979 | Coupland et al. | |
| 4,273,665 | A | 6/1981 | Braid et al. | |
| 4,328,113 | A | 5/1982 | Horodysky et al. | |
| 4,370,248 | A | 1/1983 | Horodysky et al. | |
| 4,376,712 | A | 3/1983 | Horodysky et al. | |
| 4,410,438 | A | 10/1983 | Horodysky | |
| 4,440,656 | A * | 4/1984 | Horodysky | 508/199 |
| 4,472,289 | A | 9/1984 | Horodysky et al. | |
| 4,522,734 | A | 6/1985 | Horodysky et al. | |
| 4,692,257 | A | 9/1987 | Horodysky | |
| 4,788,340 | A | 11/1988 | Horodysky | |
| 4,889,647 | A * | 12/1989 | Rowan et al. | 508/367 |
| 5,006,272 | A | 4/1991 | Andress et al. | |
| 5,364,545 | A | 11/1994 | Arai et al. | |
| 5,595,961 | A | 1/1997 | Donner et al. | |
| 5,962,377 | A * | 10/1999 | Baumgart et al. | |
| 6,034,038 | A | 3/2000 | Lockwood et al. | |
| 6,090,757 | A | 7/2000 | Steckel | |
| 6,332,974 | B1 | 12/2001 | Wittenbrink et al. | |
| 6,475,960 | B1 | 11/2002 | Berlowitz et al. | |
| 6,534,452 | B1 * | 3/2003 | Butler | 508/430 |
| 6,605,572 | B2 | 8/2003 | Carrick et al. | |
| 6,696,393 | B1 * | 2/2004 | Boffa | 508/287 |
| 6,730,638 | B2 | 5/2004 | Farng et al. | |
| 7,122,508 | B2 | 10/2006 | Boffa | |
| 7,214,648 | B2 | 5/2007 | Saini et al. | |
| 2004/0138073 | A1 * | 7/2004 | Karol et al. | 508/195 |
| 2004/0235681 | A1 | 11/2004 | Levine et al. | |
| 2005/0172543 | A1 | 8/2005 | Muir | |

FOREIGN PATENT DOCUMENTS

| | | | |
|---|---|---|---|
| EP | 0 737 735 | A2 | 10/1996 |
| JP | 2004149762 | | 5/2004 |
| WO | WO 2004/033605 | A2 | 4/2004 |

OTHER PUBLICATIONS

Molyvan TM855.*

* cited by examiner

*Primary Examiner* — Pamela H Weiss

(74) *Attorney, Agent, or Firm* — Robert A. Migliorini

(57) ABSTRACT

Disclosed are sulfur and phosphorous free, borated organomolybdenum compositions containing borated alcohols. These compositions can be formulated with ashless antioxidants and low levels of phosphorous containing antiwear compounds to provide improved lubricating compositions.

18 Claims, No Drawings

ORGANOMOLYBDENUM-BORON ADDITIVES

This application claims priority of Provisional Application 60/779,800 filed Mar. 7, 2006.

FIELD OF THE INVENTION

The present invention is directed to sulfur and phosphorous free, borated organomolybdenum compositions. More particularly, the present invention is directed toward hydroxyl-containing borated organomolybdenum compositions that are sulfur and phosphorous free and that contain borated alcohols. The invention also relates to lubricants containing the compositions of the invention.

BACKGROUND OF THE INVENTION

Contemporary lubricants such as engine oils use a wide variety of additives for enhancing the performance of the lubricants over a wide range of operating conditions. For example, additives are used to improve the antiwear performance of lubricants, to reduce friction characteristics, to increase oxidation stability and the like.

Traditionally, the principal antiwear additive for engine oils has been zinc dialkyldithiophosphate (ZDDP); and in order for a lubricating composition to meet industry standard tests and many original equipment manufacturer's specified tests for antiwear, the amount of ZDDP used in the oil is at a concentration that provides a phosphorous content in the oil of 0.08 wt % or higher. One problem arising from the use of current levels of ZDDP is the reduction of the efficiency of the catalyst converter now universally employed with gasoline powered vehicles. As a consequence, there is a new focus on reducing the levels of phosphorous in lubricating oils, especially engine oils.

Reducing the level of ZDDP in a lubricating composition, however, results in a significant reduction in the antiwear performance of the lubricating composition. For example, reducing the level of ZDDP by one half from the typical 0.08 wt % phosphorus level can result in as much as a seven-fold decrease in the antiwear performance of the lubricating composition.

SUMMARY OF THE INVENTION

Very simply, this invention is based on the discovery that certain borated organomolybdenum compounds when combined with borated alcohols can be formulated with ashless antioxidants and low levels of phosphorous containing antiwear compounds to provide improved lubricating compositions.

Accordingly, in one of its aspects, this invention comprises oil soluble, hydroxyl containing sulfur and phosphorous free, borated organomolybdenum compositions containing borated alcohols. In one embodiment, the borated organomolybdenum compositions are selected from compounds represented by formulae I and II and mixtures thereof

I

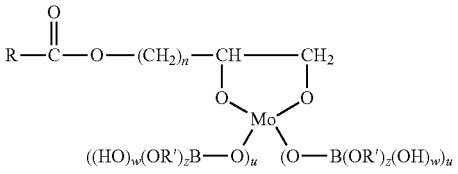

-continued

II

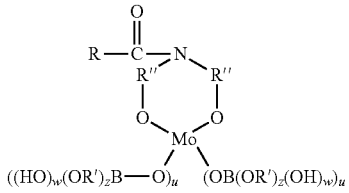

III

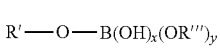

wherein R is a $C_3$ to $C_{40}$ linear or branched aliphatic groups and preferable $C_{12}$ to $C_{40}$ groups; the R's are the same or different $C_3$ to $C_{40}$ linear or branched aliphatic groups, R—(CO)—O—$C_3H_5$ groups, or R—(CO)—N—$(R'')_2$ groups where R is as previously defined; R"s are linear aliphatic groups of 2 to 4 carbons or polyalkoxylated groups and preferably polyethoxylated or polypropoxylated groups, w and z are 0, 1 or 2 and w+z=2; and u is 0 or 1.

Preferably, the borated alcohols are derived from mono, di and poly alcohols having 3 to about 35 carbon atoms and functional derivatives thereof.

Another embodiment of the invention comprises borated organomolybdenum compositions prepared by sequentially reacting a fatty oil, dialkanol amine or a di(polyalkoxylated) amine and a molybdenum source to provide molybdenum containing complexes and thereafter borating the complexes in the presence of an alcohol.

In another aspect of the invention, there is provided a lubricating oil composition comprising:

a major amount of an oil of lubricating viscosity;

an effective amount of at least one oil soluble, phosphorous and sulfur free, hydroxyl-containing borated organomolybdenum compound with at least one borated alcohol;

at least one oil soluble, phosphorous containing antiwear compound in an amount such that the weight percent of total phosphorous in the composition is less than about 0.06 wt % based on the total weight of the composition; and an effective amount of an ashless antioxidant.

These and other aspects of the invention will become apparent from the detailed description which follows.

DETAILED DESCRIPTION OF THE INVENTION

As noted above, the invention is based on the discovery that certain borated organomolybdenum compositions containing a borated alcohol or alcohols can be effectively combined with lower levels of phosphorous containing antiwear additives heretofore employed and ashless antioxidants to provide improved lubricant compositions.

Thus, one embodiment of the invention comprises oil soluble, hydroxyl-containing, sulfur- and phosphorous free borated organomolybdenum compositions containing a borated alcohol or alcohols.

In a preferred embodiment of the invention, the borated organomolybdenum compositions are represented by formulae I and II and mixtures thereof

I

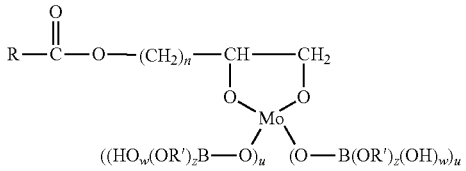

II

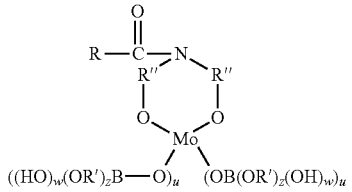

wherein R is a $C_3$ to $C_{40}$ linear or branched aliphatic groups and preferable $C_{12}$ to $C_{40}$ groups; the R's are the same or different $C_3$ to $C_{40}$ linear or branched aliphatic groups, R—(CO)—O—$C_3H_5$ groups, or R—(CO)—N—$(R'')_2$ groups where R is as previously defined; R"s are linear aliphatic groups of 2 to 4 carbons or polyalkoxylated groups and preferably polyethoxylated or polypropoxylated groups, w and z are 0, 1 or 2 and w+z=2; and u is o or 1.

The hydroxyl-containing borated organomolybdenum compounds may be prepared by borating organomolybdenum compounds having at least one reactive Mo=0 group in the molecule in the presence of an alcohol or mixture of alcohols having from about 3 to about 35 carbon atoms.

Among organomolybdenum compounds having at least one reactive Mo=0 group, those molybdenum/nitrogen-containing complexes formed by sequentially reacting a fatty oil, dialkanol amine and a molybdenum source by the condensation reaction described in U.S. Pat. No. 4,889,647, which is incorporated herein by reference, are particularly preferred. Such molybdenum/nitrogen-containing complexes are believed to comprise components III and IV

III

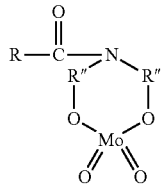

IV

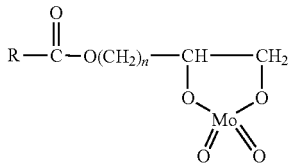

where R is a $C_3$ to $C_{40}$ linear or branched aliphatic group and preferably $C_{12}$ to $C_{40}$; the R"s are $C_2$ to $C_4$ linear aliphatic groups or polyalkoxylated groups; and n is 1 to 12.

Among polyalkoxylated groups used in preparing the molybdenum complexes polyethoxylated and polypropoxylated groups are preferred.

Suitable fatty oils used in preparing the molybdenum complexes include partially esterified polyhydric alcohols. Examples of such oils include those prepared from polyols having 3 to about 20 carbons such as trimethylolpropane, erythritol, pentaerythritol, dipentaerythritol and the like with monocarboxylic acids having from about 3 to about 40 carbon atoms and with stoichiometric amounts to result in the formation of esters having 2 or more pendant hydroxyl groups.

As stated, the organomolybdenum compound is conveniently borated in the presence of an alcohol or mixture of alcohols having from about 3 to about 35 carbon atoms and functional derivatives thereof The alcohols may be aliphatic or aromatic mono, di or poly alcohols. Examples of aliphatic mono alcohols include butyl, amyl, hexyl, isooctyl, nonyl, decyl, tridecyl and isodecyl alcohol. Examples of diols include compounds such as propane diol, neopentyl glycol and the like, and functional derivatives thereof such as 3-carboxy-1, 2 propane diol, and N-carboxyl-bis hydroxy alkylene amine. Examples of suitable aromatic alcohols are phenol, alkylated phenol, catechols, and the like. Examples of polyols include 2-ethyl-2-hydroxymethyl-1,3-propanediol, 2-methyl-2-hydroxymethyl-1,3-propanediol and pentaerylthritol.

Preferred alcohols include 2-ethyl-1-hexanol, octylalcohol and the EXXAL™ alcohols, 9, 10, 12 and 13 sold by ExxonMobil Chemical Company, Houston, Tex.

The weight ratio of the alcohols to molybdenum containing species can be varied from about 19:1 to about 1:19.

In the practice of the present invention, any boron containing compound capable of providing a source of boron for the boronating of the molybdenum and alcohol compounds may be used. Such boronating agents include boric acid, tri-methyl ortho-borate and tri-ethyl borate.

The amount of boron to total hydroxyl containing groups can be varied from about 1:9 to about 9:1.

The boronation reaction typically is carried out in an inert diluent, preferably a hydrocarbon diluent such as toluene, o-xylene, p-xylene and ethylbenzene under conditions typically employed in boronating alcohols. Thus, the reactants will be heated to a temperature and for a time sufficient to effect the boronation.

The borated organomolybdenum and alcohol compositions of the invention are useful as lubricant additives.

Indeed, in one embodiment of the invention, there is provided a lubricating composition comprising a major amount of oil of lubricating viscosity and an effective amount of the additive composition of the invention. The lubricant will also include at least one phosphorous containing, antiwear compound and an ashless antioxidant.

The oils of lubricating viscosity employed in the lubricating compositions of the invention are typically those natural and synthetic oils used in automotive and industrial applications (API base stock category Groups I, II, III, IV, V) and gas to liquid (GTL) base oils. In the present invention it is preferred that the base oil used be a Group III, IV or GTL base oil and mixtures thereof because of the low sulfur content of such base oils.

GTL base oils are those oils derived from isomerized Fischer-Tropsch waxes. Fischer-Tropsch waxes, the high boiling point residues of Fischer-Tropsch synthesis, are highly paraffinic hydrocarbons with very low sulfur content. The hydroprocessing used for the production of such base stocks may use an amorphous hydrocracking/hydroisomerization catalyst, such as one of the specialized lube hydrocracking (LHDC) catalysts or a crystalline hydrocracking/hydroisomerization catalyst, preferably a zeolitic catalyst. For example, one useful catalyst is ZSM-48 as described in U.S. Pat. No. 5,075,269. Processes using Fischer-Tropsch wax feeds are described in U.S. Pat. Nos. 4,594,172 and 4,943,672. Gas-to Liquids (GTL) base oils may be advantageously used in the instant invention, and may have useful kinematic viscosities at 100° C. of about 3 cSt to about 50 cSt, preferably about 3 cSt to about 30 cSt, more preferably about 3.5 cSt to about 25 cSt. These Gas-to-Liquids (GTL) base oils may have useful pour points of about −20° C. or lower, and under some conditions may have advantageous pour points of about −25° C. or lower, with useful pour points of about −30° C. to about −40° C. or lower.

Gas-to-Liquids (GTL) base oils have a beneficial kinematic viscosity advantage over conventional Group II and Group III base oils, which may be very advantageously used with the instant invention. Gas-to-Liquids (GTL) base oils can have significantly higher kinematic viscosities, up to about 20 to 50 cSt at 100° C., whereas by comparison commercial Group II base oils can have kinematic viscosities up to about 15 cSt at 100° C., and commercial Group III base oils can have kinematic viscosities up to about 10 cSt at 100° C. The higher kinematic viscosity range of Gas-to-Liquids (GTL) base oils, compared to the more limited kinematic viscosity range of Group II and Group III base oils, in combination with the instant invention can provide additional beneficial advantages in formulating lubricant compositions. Also, the exceptionally low sulfur content of Gas-to-Liquids (GTL) base oils, in combination with the low sulfur content of suitable olefin oligomers and/or alkyl aromatics base oils and in combination with the instant invention, can provide additional advantages in lubricant compositions where very low overall sulfur content can beneficially impact lubricant performance. In another aspect, Gas-to-Liquids (GTL) base oils have advantageously low NOACK volatility, and in combination with the instant invention can provide additional advantages in lubricant compositions.

Blends of the foregoing oils may also be used. For example, a blend of PAO's, polyesters, alkylated aromatics and polybutenes may be used as the oil of lubricating viscosity.

The additive composition of the invention may be incorporated in the lubricant in an amount sufficient to produce the desired antiwear characteristics. An amount to provide from about 80 to about 450 ppm boron and about 30 to about 5400 ppm molybdenum in the lubricating composition will be sufficient for most applications. A preferred range is to provide from about 50 to 450 ppm boron and from about 30 to 500 ppm molybdenum in the lubricating composition.

The phosphorous containing antiwear component of the lubricating composition of the invention will be selected from those zinc salts used in lubricating compositions to provide antiwear protection. The zinc salts preferably are salts of phosphorodithioic acids or dithiocarbamic acid. Among the preferred compounds are zinc dialkyldithiophosphates (ZDDP's) especially $C_3$ to $C_6$ secondary alcohol derived ZDDP's.

The phosphorous containing antiwear compound will be used in an amount such that the weight percent of phosphorous present, based on the total weight of the composition, is less than about 0.06 wt %, and preferably less than 0.05 wt %.

The lubricating composition of the invention may also include an effective amount of an ashless antioxidant. Amounts ranging from about 0.1 to about 8.0 wt %, based on the total weight of the composition, are generally sufficient although amounts ranging from about 0.2 to about 5.0 wt % are preferred and amounts from 0.5 to about 3.0 wt % are more preferred.

Typical ashless antioxidants include hindered phenolic antioxidants, arylamine antioxidants, thioethers, thioesters, thiocarbamates, and dithiocarbamates to mention a few. Examples of phenol antioxidants are mono- and bis-phenols, phenol-esters and sulfide coupled phenols. Examples of amine antioxidants are alkylated diphenylamines, alkylated phenyl-alpha-naphthylamines, alkalated aryl phenylenediamines, alkylated phenothiazines, and alkylated dihydroquinolines.

Optionally, but advantageously, the lubricating composition of the invention may include an ashless dispersant. One suitable class of dispersants is alkenylsuccinic derivatives produced from long chain substituted alkenylsuccinic compounds with polyhydroxy or polyamine compounds. The well known PIBSA-PAM represents a specific example of a suitable dispersant. Preferably, the dispersant will be borated.

The lubricating composition of the invention may also include optional additives such as those normally incorporated in lubricating compositions. Thus, the lubricating composition of the invention may include one or more of detergents, viscosity modifiers, rust inhibitors, friction modifiers, seal swell compositions, pour/point depressants, antifoamants, dyes and the like.

EXAMPLES

Additive Preparation

In the additive preparation examples which follow, the organomolybdenum composition used was MOLYVAN 855™, sold by R. T. Vanderbilt Company, Nowalk, Conn. The composition is believed to comprise the structures III and IV previously illustrated. The alcohol used was EXXAL™ 10, an isodecyl alcohol sold by ExxonMobil Chemical Co., Inc. in Houston, Tex.

Example 1

MOLYVAN 855™ (100 g), EXXAL 10™ (100 g), boric acid (26 g) and toluene (100 ml) were charged to a four-necked flask equipped with Dean Stark trap, condenser, thermometer, stirrer and nitrogen inlet. The contents were heated to 100° C. and held there for 30 minutes. The temperature was slowly raised to azeotrope temperature and held until there was no more water evolution (-4 hr.). Water was collected in the Dean Stark trap. The product was hot-filtered over celite, and the solvent was removed by evaporation, yielding a dark greenish fluid. Yield: 190.5 g.

Example 2

MOLYVAN 855™ (140 g), EXXAL 10™ (90 g), boric acid (23.5 g) and toluene (100 ml) were charged to a four-necked flask equipped with Dean Stark trap, condenser, thermometer, stirrer and nitrogen inlet. The contents were heated to 100° C. and held there for 30 minutes. The temperature was slowly raised to azeotrope temperature and held until there was no more water evolution (-4 hour). A total of 14 ml of water was collected in the Dean Stark trap. Thereafter, the solvent was removed through distillation, and the crude product was hot-filtered over celite, yielding a dark greenish fluid. Yield before filtration: 207.1 g and yield after filtration: 183.4 g.

Example 3

MOLYVAN 855™ (100 g), EXXAL 10™ (90 g), boric acid (23.5 g) and toluene (100 ml) were charged to a four-necked flask equipped with Dean Stark trap, condenser, thermometer, stirrer and nitrogen inlet. The contents were heated to 100° C. and held there for 30 minutes. The temperature was slowly raised to azeotrope temperature and held until there was no more water evolution (-4 hour). A total of 13 ml of water was collected in the Dean Stark trap. Thereafter, the solvent was removed through distillation, and the crude product was hot-filtered over celite, yielding a dark greenish fluid. Yield before filtration: 191.1 g and yield after filtration: 174.3 g.

Lubrication Formulations

Three oils were formulated using the additives of the present invention, and for comparative purposes, two were formulated without the additives of the invention. All of the oils contained the same base oil. Comparative oil A did not contain ZDDP, while comparative oil B and Oils C, D and E of the invention contained the same amount of ZDDP. Oils C, D and E contained the additive composition of the invention as shown in Table 1. All of the oils contained the same phosphorous free passenger car motor oil additive package.

TABLE 1

| Formulation | Comparative Oil A | Comparative Oil B | Example 4 Oil C | Example 5 Oil D | Example 6 Oil E |
|---|---|---|---|---|---|
| ZDDP, wt % | 0 | 0.45 | 0.45 | 0.45 | 0.45 |
| EX 1 additive, wt % | 0 | 0 | 0.5 | 1 | 0 |
| EX 3 additive, wt % | 0 | 0 | 0 | 0 | 1 |
| Additive package, wt % | Same treat (17.37 wt %) | Same treat | Same treat | Same treat | Same treat |
| Base Oil | Bal. | Bal. | Bal. | Bal. | Bal. |
| Inspections | | | | | |
| % P | 0 | 0.045 | 0.045 | 0.045 | 0.045 |
| Solubility & Appearance | C&B | C&B | C&B | C&B | C&B |

As illustrated in the attached Table 2, very good friction reduction, antioxidation and antiwear control can be achieved with the borated alcohol-hydroxyl molybdenum additives (Example 1 and 3) on low phosphorus passenger vehicle lubricants (PVL). As shown in the High Frequency Reciprocating Rig (HFRR), both Example 1 and Example 3 can help maintain excellent frictional properties as evidenced by the low average coefficients of friction (CoF) measured. Adding 0.5 wt % and 1.0 wt % of borated Example 1 to the same base formulation, the resulting oil C and oil D can lower the average friction by 17 to 22.4% in condition set one and 20.9 to 27.6% in condition set two (in comparison to oil B). Likewise, adding 1.0 wt % of borated Example 3 to the same base formulation, oil E can lower the average friction by 41.2% in condition set one and 38% in condition set two. Comparing to others, the results are very significant as most other conventional friction modifying agents can only offer 0 to 15% friction reduction. In test condition two, oil B has only 36.5% average film via electric contact potential (ECP) measurements. That means not enough film formation is present during the test, while adding borated additives of this invention can improve the film formation frequency up to 85% range.

TABLE 2

| Test | | Comparative Oil A | Comparative Oil B | Example 4 Oil C | Example 5 Oil D | Example 6 Oil E |
|---|---|---|---|---|---|---|
| PDSC | Onset, ° C. | 257.80 | 268.4 | 278.1 | 275.9 | 280.2 |
| HFRR | Average Friction | 0.124 | 0.136 | 0.113 | 0.092 | 0.08 |
| .5 Kg/60 Hz/ .5 mm | % Average Film | 93.99 | 77.92 | 84.4 | 88.12 | 87.89 |
| 100° C. | Scar X/Y (mm) | 0.33/0.73 | 0.23/0.7 | 0.2/0.7 | 0.23/0.7 | 0.23/0.7 |
| Set one HFRR | Calc. scar area | 0.192 | 0.128 | 0.11 | 0.128 | 0.128 |
| .7 Kg/60 Hz/ .5 mm | Average Friction | 0.145 | 0.134 | 0.106 | 0.097 | 0.083 |
| 60 mm/ 75° C. | % Avg Film | 22.06 | 36.49 | 85.46 | 83.12 | 85.97 |
| | Scar X/Y (mm) | | 0.28/0.73 | 0.267/ 0.7 | 0.30/0.7 | 0.30/0.7 |
| Set Two | Calc. scar area | | 0.163 | 0.147 | 0.165 | 0.165 |
| ASTM | | | | | | |
| D874 | wt % sulfate oil | 0.3 | 0.46 | 0.5 | 0.51 | 0.52 |
| D6443 | wt % phosphorous | <.002 | 0.0459 | 0.0468 | 0.046 | 0.0469 |
| D6443 | wt % zinc | <.002 | 0.0499 | 0.0504 | 0.0495 | 0.0506 |
| D6443 | wt % calcium | 0.0895 | 0.0888 | 0.0884 | 0.0868 | 0.087 |
| D6443 | wt % sulfur | 0.0396 | 0.1339 | 0.1302 | 0.1332 | 0.1307 |

The wear results recorded in Table 2 indicate that oils C, D and E have either equivalent or smaller (10 to 14% reduction) calculated wear scar areas; therefore, the antiwear protection is sufficient with the new additives.

Also as illustrated in Table 2, very good antioxidancy is achieved with the borated mix alcohols, hydroxyl-containing molybdenum additives of the invention. As shown in Pressure Differential Scanning Calorimetry (PDSC), the onset temperature of oil C and oil D is 7.5 to 9.7 degrees higher than the result of oil B and 18.1 to 20.3 degrees higher than the result of oil A. Since oxidation rates generally double with about 10° C. increase in temperature, these results can be translated into about 75% to 97% better in terms of control of viscosity or acid number increases or any other comparable measurements for control of oxidation (i.e., oxygen uptake). Likewise, the onset temperature of oil E is 11.8 degrees higher than the result of oil B and 22.4 degrees higher than the result of oil A, translating into about 118% better in oxidation control.

What is claimed is:

1. A lubricant additive composition comprising:

at least one phosphorous and sulfur free, hydroxyl containing borated organomolybdenum compound; and at least one borated alcohol having from about 3 to about 35 carbon atoms.

2. The composition of claim 1 wherein the at least one phosphorous and sulfur free, hydroxyl containing borated organomolybdenum compound is represented by one of Formula I or II:

I

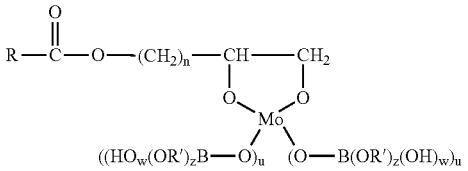

II

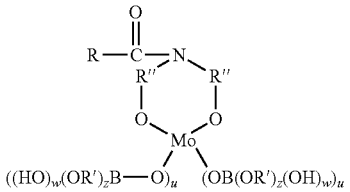

wherein

R is a $C_3$ to $C_{40}$ linear or branched aliphatic group;

the R's are the same or different, with each representing a $C_3$ to $C_{40}$ linear or branched aliphatic group, a R—(CO)—O—$C_3H_5$ group or a R—(CO)—N—$(R'')_2$ group, where R is as previously defined;

the R"s are each a linear $C_2$ to $C_4$ aliphatic group or a polyalkoxylated group;

w and z are each 0, 1 or 2; w+z=2; and u is 0 or 1, such that a hydroxyl group is present; and n is 1 to 12.

3. The composition of claim 2 wherein the at least one borated alcohol is derived from mono, di and polyalcohols.

4. The composition of claim 3 wherein the ratio of alcohol to molybdenum compound is in the range of about 19:1 to 1:19.

5. The composition of claim 4 wherein the range of boron to total hydroxyl groups is in the range of about 1:9 to about 9:1.

6. A lubricant composition comprising:

a major amount of an oil of lubricating viscosity;

an effective amount of at least one sulfur and phosphorous free, hydroxyl containing borated organomolybdenum compound;

at least one oil soluble, phosphorous-containing antiwear compound in an amount such that the weight percent of total phosphorous in the total lubricating composition is less than about 0.06 wt %; and an effective amount of an ashless antioxidant.

7. The lubricant composition of claim 6 wherein the at least one phosphorous and sulfur free, hydroxyl containing borated organomolybdenum compound is represented by one of Formula I or II

I

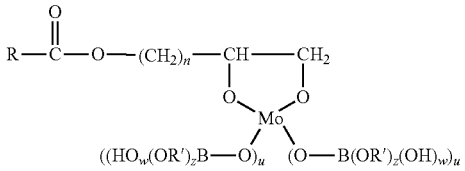

II

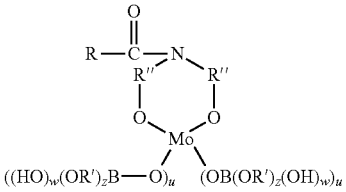

wherein

R is a $C_3$ to $C_{40}$ linear or branched aliphatic group;

the R's are the same or different, with each representing a $C_3$ to $C_{40}$ linear or branched aliphatic group, a R—(CO)—O—$C_3H_5$ group or a R—(CO)—N—$(R'')_2$ group, where R is as previously defined;

the R"s are each a linear $C_2$ to $C_4$ aliphatic group or a polyalkoxylated group;

w and z are each 0, 1 or 2; w+z=2; and u is 0 or 1, such that a hydroxyl group is present; and n is 1 to 12.

8. The composition of claim 7 wherein the at least one borated alcohol is selected from mono, di and polyalcohols.

9. The composition of claim 8 wherein the ratio of alcohol to molybdenum compound is in the range of about 19:1 to 1:19.

10. The composition of claim 9 wherein the range of boron to hydroxyl and Mo groups is in the range of about 1:9 to about 9:1.

11. The composition of claim 10 wherein the phosphorous-containing antiwear compound is ZDDP.

12. The composition of claim 11 wherein the ashless antioxidant is a mixture of hindered phenols and arylamines.

13. The composition of claim 6 further comprising at least one borated alcohol having from about 3 to about 35 carbon atoms.

14. A lubricant additive composition comprising:

at least one phosphorous and sulfur free, hydroxyl containing borated organomolybdenum compound, wherein the hydroxyl containing borated organomolybdenum compound is a reaction product of at least one organomolybdenum compound having at least one reactive Mo=O group, at least one boronating agent, and at least one alcohol having from 3 to 35 carbons; and at least one borated alcohol having from about 3 to about 35 carbon atoms.

15. The lubricant of claim 14, wherein at least one boronating agent is selected from the group consisting of boric acid, tri-methyl ortho-borate and tri-ethyl borate.

16. The lubricant of claim 14, wherein the at least one alcohol having from 3 to 35 carbons is an aliphatic mono alcohol.

17. The lubricant of claim 16, wherein the aliphatic mono alcohol is selected from the group consisting of butyl, amyl, hexyl, isooctyl, nonyl, decyl, tridecyl and isodecyl alcohol.

18. The lubricant of claim 17, wherein the aliphatic mono alcohol is 2-ethyl-l- hexanol.

* * * * *